US010940704B2

(12) United States Patent
Terradellas Callau et al.

(10) Patent No.: US 10,940,704 B2
(45) Date of Patent: Mar. 9, 2021

(54) CONVEYOR BELT SENSORS

(71) Applicant: HEWLETT-PACKARD DEVELOPMENT COMPANY, L.P., Spring, TX (US)

(72) Inventors: Roger Terradellas Callau, Sant Cugat del Valles (ES); Inaki Zudaire Rovira, Sant Cugat del Valles (ES); Daniel Gutierrez Garcia, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/487,408

(22) PCT Filed: Jun. 12, 2017

(86) PCT No.: PCT/US2017/037017
§ 371 (c)(1),
(2) Date: Aug. 20, 2019

(87) PCT Pub. No.: WO2018/231190
PCT Pub. Date: Dec. 20, 2018

(65) Prior Publication Data
US 2019/0366743 A1 Dec. 5, 2019

(51) Int. Cl.
*B41J 13/00* (2006.01)
*B41J 11/00* (2006.01)

(52) U.S. Cl.
CPC ..... *B41J 13/0009* (2013.01); *B41J 11/007* (2013.01); *B41J 11/008* (2013.01)

(58) Field of Classification Search
CPC ..... B41J 13/0009; B41J 11/007; B41J 11/008
See application file for complete search history.

(56) References Cited

U.S. PATENT DOCUMENTS 5,510,877 A 4/1996 Dejong et al.
8,608,273 B2 12/2013 Ernst et al.
(Continued)

FOREIGN PATENT DOCUMENTS

JP 2005041582 2/2005
JP 2011002632 1/2011
(Continued)

OTHER PUBLICATIONS

Cole, S. et al; A Novel Approach to Print Head Alignment for Wide Format Printers, ImageXpert Inc. Nashua, NH, US, Society for Imaging Science and Technology; Jan. 1, 2005.

*Primary Examiner* — Yaovi M Ameh
(74) *Attorney, Agent, or Firm* — HP Inc. Patent Department

(57) ABSTRACT

In one example, a printing system is described, having a conveyor belt, a first optical sensor, a second optical sensor, and a controller. The first optical sensor is located proximate to a first edge of the conveyor belt. The second optical sensor is located proximate to a second edge of the conveyor belt, wherein the second edge is on the opposite side of the conveyor belt to the first edge. The controller receives data related to optical detection of lateral movement of the conveyor belt from the first and second optical sensors, and causes a correction for the detected lateral movement of the conveyor belt in association with a print job of the printing system.

19 Claims, 4 Drawing Sheets

(56) References Cited

U.S. PATENT DOCUMENTS

| | | | | |
|---|---|---|---|---|
| 9,028,027 | B2 | 5/2015 | Bell et al. | |
| 2002/0134651 | A1* | 9/2002 | Itoh | B65G 39/16 198/835 |
| 2005/0078137 | A1 | 4/2005 | Femando et al. | |
| 2010/0232819 | A1* | 9/2010 | Kudo | G03G 15/6564 399/66 |
| 2010/0294624 | A1* | 11/2010 | Warner | B65G 43/02 198/502.2 |
| 2012/0213558 | A1* | 8/2012 | Krucinski | G03G 15/1605 399/302 |
| 2015/0138288 | A1 | 5/2015 | Chen et al. | |

FOREIGN PATENT DOCUMENTS

| | | | |
|---|---|---|---|
| WO | WO-14005608 | | 1/2014 |
| WO | WO-2014047512 | A2 | 3/2014 |

* cited by examiner

CONVEYOR BELT SENSORS

BACKGROUND

Conveyor belts for printers may be arranged to move print media in a printing system in coordination with printing components to produce a printed image or generate an object. The conveyor belt supports and moves the print media during printing. The conveyor belt may be positioned around rollers in an assembly which may include a driving mechanism to apply a force to the conveyor belt to cause it to move on the rollers.

BRIEF DESCRIPTION OF THE DRAWINGS

Various features of the present disclosure will be apparent from the detailed description which follows, taken in conjunction with the accompanying drawings, which together illustrate certain examples, and wherein.

DETAILED DESCRIPTION

Figure 1:
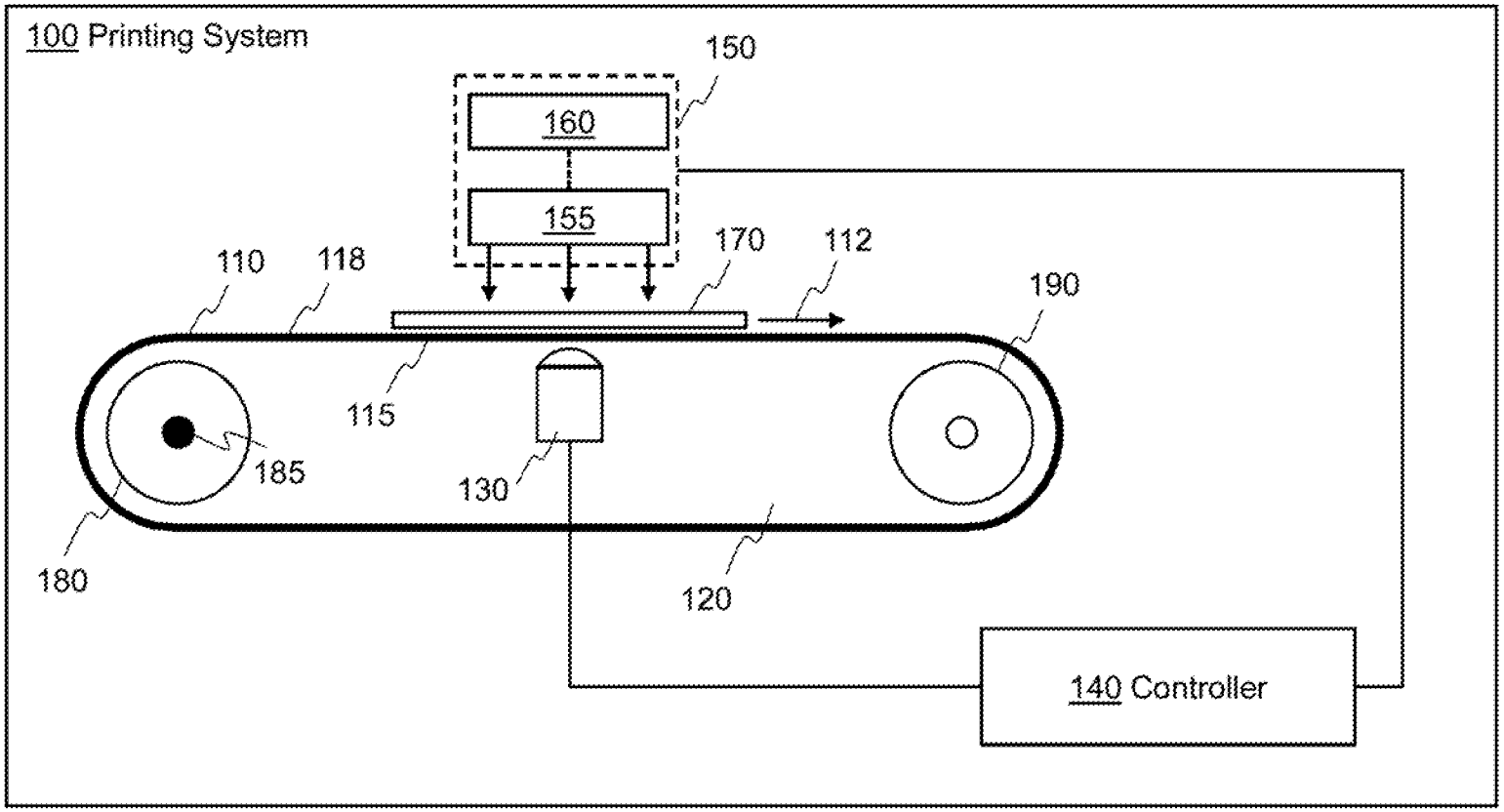
FIG. 1 is a schematic illustration showing a printing system according to an example.

Certain examples described herein relate to printing systems with a conveyor belt to convey print media. In some examples, the printing system may be a two-dimensional (2D) printing system such as an inkjet or digital offset printer. In these examples, the print media may comprise paper, cardstock, boards, metal sheets, plastic sheets, and the like. A sheet of print media may rest on top of the conveyor belt and be driven through a print zone. In the print zone, printing fluid may be applied, e.g. using inkjet print heads mounted above the conveyor belt. In other examples, the printing system may be a three-dimensional (3D) printing system, otherwise known as an additive manufacturing system. In these examples, the print media may comprise a build material. For example, the build material may be deposited on top of the conveyor belt and be driven through the additive manufacturing system. Some additive manufacturing systems use a "layer-by-layer" approach, where a solidification process is applied to each layer of deposited build material before the next layer of build material is applied. In certain printing systems, a vacuum mechanism may be used to secure the print media to the conveyor belt via suction.

In printing systems, the conveyor belt may slip in its lateral position with respect to other components of the system, for example print heads in the print zone, due to a tension of the conveyor belt being too low. Such lateral deviations of the conveyor belt may be worsened by reversing of the conveyor belt during a print job, which may be programmed or manually commanded by a user of the printing system. These reverse movements of the conveyor belt may act to increase lateral displacement of the conveyor belt, which may impact subsequent printing operations.

Additionally or alternatively, changes in temperature or humidity in the surroundings of the conveyor belt, or a shear tension applied to the conveyor belt, may cause the conveyor belt to expand or contract in size.

These factors can negatively affect the resulting printed image quality produced by the printing system. As the conveyor belt moves laterally, for example by lateral displacement or size-change or both, the print media conveyed by the conveyor belt may also move laterally in a similar way below the print engine. This may cause a misalignment or miscalibration between the print engine and the print media, compared to what is desired as part of the print job, and thus may cause errors in the resulting printed image. Such errors may be more noticeable near an edge of the print media. Leaving aside expansion/contraction phenomena of the conveyor belt, which may be a magnitude lower than lateral deviation, the print engine may apply printing fluid past the edge of the print media or may leave unprinted borders depending on how the conveyor belt has moved laterally versus the initial media loading position.

Some approaches to systems for guiding the conveyor belt in order to maintain alignment between the print engine and print media conveyed by the conveyor belt may be passive, for example implementing crown shaped rollers or physical stoppers. These systems may therefore not receive active feedback as to any lateral movement of the conveyor belt.

Certain examples described herein act to reduce misalignment between the print engine and the print media by compensating or correcting for lateral movement of the conveyor belt. In these examples, first and second optical sensors are positioned proximate to a first edge and a second edge, respectively, of the conveyor belt. The first and second optical sensors can optically detect lateral movement of the conveyor belt in the proximity of the respective edge of the conveyor belt. Implementing first and second optical sensors, and collating the data therefrom allows dissociation of lateral displacement and size-change of the conveyor belt. A compensation or correction for the overall detected lateral movement of the conveyor belt can then be applied in association with a print job of the print system.

The lateral movement of the conveyor belt, optically detected by the first and second optical sensors, can be used to make adjustments to the operation of complementary devices (e.g. print head, sprayer, imaging drum, etc.), to compensate for any lateral deviation and/or lateral size-change of the conveyor belt. For example, a physical position of the print engine may be modified to correct or compensate for the optically detected lateral movement of the conveyor belt. Additionally or alternatively, print data for the print job can be corrected or compensated by adjusting lateral dimensions of a virtual image prior to firing the print engine. In some cases, the conveyor belt may additionally or alternatively be precisely controlled, based on its optically detected lateral movement, to improve accuracy in the position and/or advancement of the print media with respect to other components of the printing system. For example, a drive roller to move the conveyor belt may be adjusted in position to correct or compensate for the optically detected lateral movement of the conveyor belt. A correction roller may additionally or alternatively be implemented to move in its position to modify a lateral position of the conveyor belt in order to correct or compensate for the optically detected lateral movement of the conveyor belt.

With such correction or compensation applied for the optically detected lateral movement of the conveyor belt, printing systems may reduce errors in printing images, and therefore improve overall image quality and consistency. For example, the print engine may more reliably print at full bleed (that is, edge-to-edge on the print media) with a reduced chance of leaving an unprinted border at the edge.

Certain examples will now be described with reference to the Figures.

FIG. 1 shows schematically a printing system 100. The printing system comprises a conveyor belt 110. The conveyor belt 110 may include a loop or band of material with sufficient flexibility to bend or deform around rollers for moving the conveyor belt. In some implementations, the conveyor belt 110 can include segmented rigid or semi-rigid sections coupled to one another by hinged connectors.

The conveyor belt 110 may be disposed around a drive roller 180 and an idle roller 190 in examples. The drive roller 180 may comprise a drive mechanism 185, for example a motor or a motorized shaft, for turning the drive roller 180. In turn, the drive roller 180 can apply a force to the conveyor belt 110 that causes it to move about the rollers 180, 190. As such, rotational movement of the drive roller 180 can be translated into corresponding linear motion of the conveyor belt 110. The linear motion of the conveyor belt 110 can then be used to move material disposed thereon.

In examples, the conveyor belt 110 is elongate with a length in a conveyance direction 112 that the conveyor belt 110 moves in, and a lateral dimension or width in a direction perpendicular to the conveyance direction 112, wherein the length may be larger than the width.

The conveyor belt 110 may include an interior surface 115 and an exterior surface 118. The exterior surface can be used as a surface on which materials, media, or objects are carried, for example print media 170. The object may be held to the exterior surface by gravity, friction, clamps, or vacuum. The interior surface 115 may be considered the surface of the conveyor belt 110 in contact with or disposed in proximity to the rollers on which the conveyor belt moves. As such, the conveyor belt 110 can define an interior and exterior relative to the conveyor belt 110. For example, the region within the confines of the loop of the conveyor belt 110 and proximate to the interior surface 115 of the conveyor belt 110 can be referred to herein as the conveyor belt interior 120.

The printing system 100 comprises a first optical sensor 130 located proximate to a first edge of the conveyor belt 110. The first edge of the conveyor belt 110 may be considered to be a region or area of the conveyor belt 110 at or near an extremity of the conveyor belt 110 in its lateral dimension.

The printing system 100 also comprises a second optical sensor (not shown in FIG. 1) located proximate to a second edge of the conveyor belt 110. The second edge is on the opposite side of the conveyor belt to the first edge. For example, the second edge of the conveyor belt 110 may be considered to be a region or area of the conveyor belt 110 at or near the opposite extremity of its lateral dimension relative to the first edge.

The first and second optical sensors 130 can optically detect movement of the conveyor belt 110. In various implementations, each optical sensor 130 can include a light sensor or complementary optical components for detecting the movements of the conveyor belt 110 (e.g. the interior surface 115 of the conveyor belt 110). For example, each optical sensor 130 may include a complementary metal-oxide semiconductor (CMOS) sensor, a charge coupled device (CCD) sensor, a photomultiplier, or any type of light-sensitive electronic device. The optical components of each optical sensor 130 can include any configuration of lenses, light guides, optical fibers, mirrors, etc.

In some implementations, either or both of the first and second optical sensors 130 may also include a light source (not shown), such as an LED, an incandescent lamp, a laser, or the like, to illuminate the conveyor belt 110 (e.g. the interior surface 115 of the conveyor belt 110). In other implementations, the light source may be a separate device and directed toward the region that the first or second optical sensor 130 is intended to detect. The spectral content of the light source can be specifically selected to increase the detectability of the movement of the conveyor belt 110.

In other implementations, instead of, or in addition to, detecting light reflected off the conveyor belt 110 (e.g. the interior surface 115 of the conveyor belt 110), either or both of the first and second optical sensors 130 may detect light that passes through the conveyor belt 110. For example, in implementations in which the conveyor belt 110 includes perforations, holes, or other gaps, either or both of the first and second optical sensors 130 may detect differentials in light that passes through the conveyor belt 110 as it moves. In such implementations, a light source can be disposed in proximity to the exterior of the conveyor belt 110 to provide the "bright" light signal reference point.

In some implementations, the optical components can include lenses that include profiles and optical power to conform to or match the shape and/or dimensions of the conveyor belt 110 (e.g. the interior surface 115 of the conveyor belt 110). For example, optical components of either or both of the first and second optical sensors 130 can include a light guide or lens disposed in dose proximity to conveyor belt 110 to detect variations in the light received from or through the conveyor belt 110. The same or complementary optical components can be used to guide or focus light from a light source onto a region of the conveyor belt 110 monitored by the first and/or second optical sensor 130.

In some implementations, the optical components may include an imaging lens focused on the inherent pattern, texture, or grain of the material of the conveyor belt 110.

In other implementations, the interior surface of the conveyor belt 110 can include regularly or randomly arranged markings that provide contrasting levels of reflectance relative to the inherent reflectance of the material of the conveyor belt 110. For example, the markings can include a series of regularly spaced dots, lines, or hash marks, imprinted on the interior surface of the conveyor belt 110. In such implementations, the markings can be made with an ink, paint, pigment, or other material that is lighter than or darker than the material of the conveyor belt 110 so as to provide contrasting reflectance.

In some implementations, the markings can include a material that has a different specular reflectance characteristic (e.g. shininess) relative to the material of the conveyor belt 110. For example, the markings can be glossy while the material on the interior of the conveyor belt 110 is matte. For example, the interior surface 115 or exterior surface of the conveyor belt 110 can be embedded with shiny metal pieces (e.g. foil) that may be more reflective than the surrounding material (e.g. rubber, fabric, etc.) in the conveyor belt interior 120 or exterior. As such, the light received by each optical sensor 130 from the conveyor belt 110 can be reflected off the respective surface and any markings thereon.

As the conveyor belt 110 moves in the conveyance direction 112, variations in light reflected off the conveyor belt 110 and detected by each optical sensor 130 can be interpreted as movement of the belt 110. Movement of the belt 110, in addition to that in the conveyance direction 112, may also be lateral (that is, in a direction perpendicular to the conveyance direction 112). Thus, the variations in the reflected light detected by each optical sensor 130 can be interpreted as lateral movement of the conveyor belt 110 in the region of the belt that the respective optical sensor 130 is intended to detect.

The printing system 100 comprises a controller 140 to receive data related to optical detection of lateral movement of the conveyor belt 110 from the first and second optical sensors 130. For example, in some implementations, the controller 140 can analyze the light level signals detected by the first and second optical sensors 130. The controller 140 causes a correction for the detected lateral movement of the conveyor belt 110 in association with a print job of the printing system 100. The correction may be to one or more of: print data associated with the print job; a physical position of a print engine of the printing system; and a lateral position of the conveyor belt relative to a roller 180, 190 or another component of the printing system.

Some conveyor belt materials can expand, contract, or experience other changes in a physical property or properties, when subjected to heating and cooling. Expansion and contraction of the conveyor belt 110 can alter the width, or potentially change the coefficient of friction or elasticity of the conveyor belt 110, for example. Such physical changes to the conveyor belt 110 can cause lateral movement of the belt 110. Lateral movement of the conveyor belt 110 may be an increase or decrease in its width, and/or a change in a lateral position of the belt 110. For example, physical changes to the conveyor belt 110 may in some cases cause the belt 110 to slip on the rollers, which can shift the belt 110 laterally left or right. In some cases, the belt 110 may slip on the rollers 180, 190 due to incorrect tensioning of the conveyor belt 110 about the rollers 180, 190. Information regarding the lateral movement of the conveyor belt 110 optically detected by the optical sensors in localized regions, at opposite edges of the conveyor belt 110, can be used to compensate for effects of heating, cooling or tensioning of the conveyor belt 110.

For example, in various implementations, the first and/or second optical sensor 130 can be located proximate to a region of the interior surface 115 of the conveyor belt 110 opposite a region of the exterior surface of the conveyor belt 110 that is near a print engine 150. The region of the exterior surface of the conveyor belt 110 near a print engine 150 is referred to herein as the "print zone". In such implementations, use of the first and second optical sensors 130 can compensate or correct for the effects of uneven or localized heating of the conveyor belt 110 in the print zone. For example, some printing technologies, such as large format latex printing, piezoelectric inkjet printing, thermal inkjet printing, and other printing technologies that use heat in some part of the printing process (e.g., during the application, drying, or curing of print material) in the print zone or other region of the conveyor belt 110, can cause the conveyor belt 110 and/or print media 170 conveyed by the belt 110 to heat up and cool down unevenly.

In some implementations, with the printing system 100 comprising the print engine 150 and the conveyor belt 110 to move print media 170 relative to the print engine 150, the controller 140 may cause the correction to modify print data associated with the print job. The print data can include information or encoded data that can be used to render an image on the print media with the print engine. For example, the print data may be stored in a buffer 160 communicatively coupled to, or comprised within, the print engine 150. A print controller, which may be (or comprised within) the controller 140, or communicatively coupled to the controller 140, can then generate instructions, based on the print data, for controlling the print engine 150 to apply a printing material to the print media 170 to generate a corresponding printed image. In some examples, the instructions generated based on the print data in the buffer 160 may be applied to a print head (or print heads) 155 as part of the print engine 150. The print heads 155 may apply printing material or printing fluid (such as ink) to the print media 170, based on the generated instructions, during the print job of the printing system 100. In these implementations, modifying the print data may involve modifying a virtual image. For example, the virtual image (corresponding to a real image for rendering on the print media 170) may be shifted laterally in a virtual coordinate space to correct for lateral movement of the conveyor belt 115.

Modifying the print data associated with the print job may then affect the instructions for the print engine 150 that are generated from the print data. This modification may therefore cause a modification to the image rendered on the print media 170. The image rendered on the print media 170 can therefore be corrected for the detected lateral movement of the conveyor belt 110.

In some cases where print heads 155 are implemented, the print heads 155 may move laterally, or side-to-side, as the conveyor belt 110 moves intermittently in the conveyance direction 112. In these cases, modification of the print data, for example a virtual image shift, may occur between successive applications of printing material to the print media 170 by the print heads 155.

In some implementations where the printing system 100 comprises the print engine 150 and the conveyor belt 110 to move print media 170 relative to the print engine 150, the controller 140 may cause the correction to the print engine 150. For example, in these implementations, the controller 140 may modify directly the instructions for the print engine 150, to apply a printing material to the print media 170. In some examples, the correction to the print engine 150 comprises a modified physical position of the print engine 150, such as modifying print head 155 positions relative to the conveyor belt 110 or print media 170, the print heads 155 comprised as part of the print engine 150. For example, in page-wide array printing systems, the correction could be to a firing position of a print head 155 along a print bar, or to one or more firing instructions for multiple nozzles comprised as part of the print head 155.

In other implementations, the controller 140 may cause the correction to modify a lateral position of the conveyor belt 110. For example, the optically detected lateral movement of the conveyor belt 110 can be used to accurately position or move the conveyor belt 110, and/or a print media 170 disposed thereon, relative to other components of a printer (e.g. a print engine 150 in the print zone) to produce a printed image or object. For example, if the position of the conveyor belt 110 as determined by the optical sensors 130 is determined to be laterally offset from where it is expected to be (e.g. not in the correct position relative to other components of a printer, such as the print engine 150 or a dryer), then the signal that controls the driver roller 180 can be adjusted to move a roller (which could be the drive roller 180, idle roller 190 or other roller) to correct the lateral positioning of the conveyor belt 110. As previously described, the printer may be a 2D printer (e.g. an inkjet, laser or digital offset printer) or a 3D printer (e.g. a selective laser sintering, stereo lithography, inkjet deposition, or laminated object manufacturing system). The print media 170 disposed on the conveyor belt may comprise a sheet of paper or other material for rendering an image on in examples employing a 2D printer, or may comprise a build material for generating a 3D object from in examples employing a 3D printer.

The controller 140 can include a processor and a memory. Computer executable code that includes instructions for performing various operations of the controller described herein can be stored in the memory. For example, the functionality for controlling or interacting with the optical sensors 130 can be implemented as executable optical sensor control code stored in the memory and executed by the processor. As such, the executable code stored in the memory can include instructions for operations that when executed by processor cause the processor to implement the functionality described in reference to the example controller 140. Similarly, the print controller (if implemented separately to the controller 140) can also include a processor and a memory. Computer executable code that includes instructions for performing various operations of the print controller can be stored in the memory. For example, the functionality for driving the drive roller 180 or drive mechanism 185, and controlling the print engine 150 can be implemented as executable conveyor belt drive code and print engine control code, respectively, and stored in the print controller memory and executed by the print controller processor.

A processor, as described herein, may be a microprocessor, a micro-controller, an application specific integrated circuit (ASIC), or the like. In examples, a processor is a hardware component, such as a circuit.

A memory, as described herein, can include any type of transitory or non-transitory computer readable medium. For example a memory can include volatile or non-volatile memory, such as dynamic random access memory (DRAM), electrically erasable programmable read-only memory (EEPROM), magneto-resistive random access memory (MRAM), memristor, flash memory, a floppy disk, a compact disc read only memory (CD-ROM), a digital video disc read only memory (DVD-ROM), or other optical or magnetic media, and the like, on which executable code may be stored.

Figure 2:
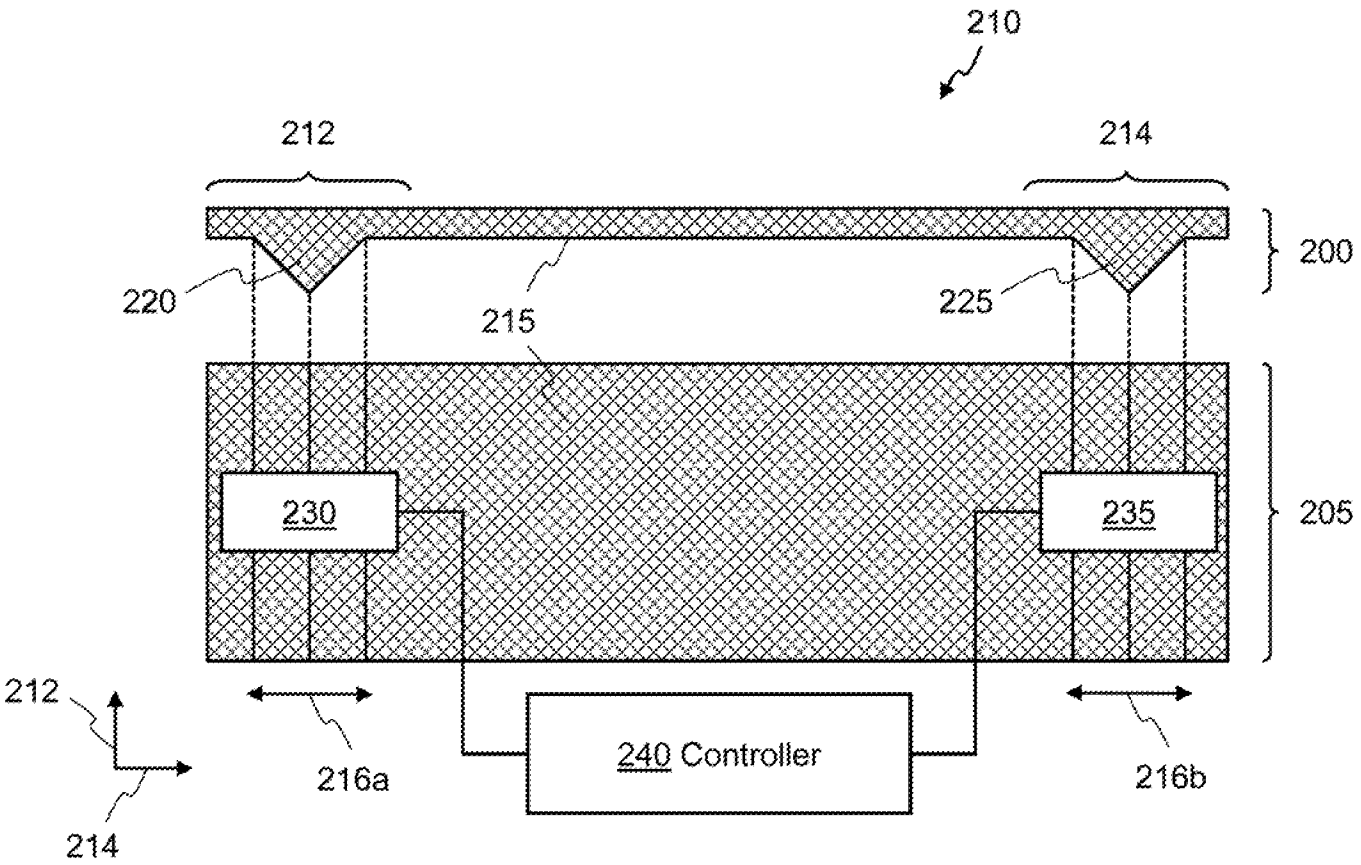
FIG. 2 is a schematic illustration showing corresponding cross sectional views of a conveyor belt for a printing system according to an example.

FIG. 2 shows schematically corresponding cross-sectional views 200 and 205 of an example conveyor belt 210 for a printing system. In certain examples, the conveyor belt 210 shown in FIG. 2 may be implemented as the conveyor belt 110 in the printing system 100 shown in FIG. 1.

As described with reference to the example shown in FIG. 2, the printing system comprises a first optical sensor 230 located proximate to a first edge 212 of the conveyor belt 210. A second optical sensor 235 is located proximate to a second edge 214 of the conveyor belt 210, wherein the second edge 214 is on the opposite side of the conveyor belt 210 to the first edge 212. A controller 240 of the printing system can receive data related to optical detection of lateral movement 216*a*, 216*b* of the conveyor belt 210 from the first and second optical sensors 230, 235. The controller 240 can then cause a correction for the detected lateral movement 216*a*, 216*b* of the conveyor belt 210 in association with a print job of the printing system.

Lateral movement 216*a*, 216*b* of the conveyor belt 210 may be considered to be movement of the conveyor belt 210 in a lateral direction 214 perpendicular to a conveyance direction 212 in which the conveyor belt 210 is moving to convey material e.g. print media in the printing system.

Optical detection of lateral movement of the conveyor is described above with reference to the example of FIG. 1. In some implementations, an interior surface 215 of the conveyor belt 210 comprises a first ridge 220 and a second ridge 225, as shown in FIG. 2. In these implementations, the first optical sensor 230 is located proximate to the first ridge 220 to detect lateral movement 216*a* of the conveyor belt 210; and the second optical sensor 235 is located proximate to the second ridge 225 to detect lateral movement 216*b* of the conveyor belt.

The optical sensors 230, 235 can be disposed at any angle relative to the interior surface 215 of the ridged conveyor belt 210 and/or the ridges 220, 225.

In some examples, the first and second optical sensors 230, 235 may detect variations in light on the inherent pattern, texture, or grain of the material of the conveyor belt 110. In particular, the optical sensors 230, 235 may detect variations in light of the respective ridge 220, 225 to infer lateral movement 216*a*. 216*b* in the respective region of the conveyor belt 210.

In other examples, the first and second ridges 220, 225 each comprise one or more markings detectable by the respective optical sensor 230, 235, from which lateral movement 216*a*, 216*b* of the conveyor belt 210 may be inferred.

Implementing first and second optical sensors 230, 235 in this way allows the controller 240 to determine whether the lateral movement of the conveyor belt 210 is due to: a lateral shift or slip of the conveyor belt 210; or lateral expansion or contraction of the conveyor belt 210; or a combination thereof. For example, if the first and second optical sensors 230, 235 detect the same amount of lateral movement of the conveyor belt 210 in the same direction, the controller can infer a lateral shift or displacement of the belt 210. As a particular example, a lateral movement of 5 microns to the right detected by both optical sensors 230, 235 could be interpreted by the controller 240 as a lateral displacement of the conveyor belt 210 by 5 microns to the right. However, if the first and second optical sensors 230, 235 detect differing amounts of lateral movement 216*a*, 216*b* of the conveyor belt 210, the control 240 can interpret a degree of lateral expansion or contraction. As a particular example, a lateral movement 216*a* of 5 microns to the right detected by the first optical sensor 230, and a lateral movement 216*b* of 5 microns to the left detected by the second optical sensor 235 could be interpreted by the controller 240 as a lateral contraction of the conveyor belt by 10 microns.

In some implementations, the conveyor belt 210 can be subjected to uneven heating, such that the material of the conveyor belt 210 may contract and expand unevenly. In such implementations, the light and dark signals detected by the optical sensors 230, 235 can be used to determine the size change (expansion or contraction) of the conveyor belt 210 at the first and second edges 212, 214.

The correction caused by the controller 240, in association with a print job of the printing system implementing the first and second optical sensors 230, 235, may therefore account for either lateral displacement, or lateral size change (expansion/contraction) of the conveyor belt 210, or both. This distinction may not be realised by employing just one optical sensor.

The V-shaped ridge profile of the first and second ridges 220, 225 shown in FIG. 2 is an example: the first and second ridges 220, 225 may each have another profile, for example a trapezoidal or truncated V-shaped ridge profile.

Referring back to FIG. 1, the shape, angle, location, and dimension of the ridge profiles on a particular conveyor belt 110 can vary based on the dimensions of the rollers 180, 190 and/or the location, size, and cross sectional profile of a groove in the rollers 180, 190. For example, the dimensions and angles of the ridge profiles can correspond to grooves (not shown) in the rollers 180, 190. The ridge profiles can be dimensioned to fit into the grooves to help keep the conveyor belt 110 aligned on the rollers 180, 190 and/or with respect to the optical sensors 130 or other devices in the printing system 100.

For example, the drive roller 180 may have a first groove, and the idle roller 190 may have a second groove, with the first ridge of the conveyor belt 110 disposed in the first and second grooves to maintain alignment of the conveyor belt 110.

In some examples, the drive roller may additionally have a third groove, and the idle roller may additionally have a fourth groove, with the second ridge of the conveyor belt 110 disposed in the third and fourth grooves to maintain alignment of the conveyor belt 110.

In some implementations, the print system 100 can include a vacuum handler, positioned in the conveyor belt interior 120, to exert vacuum pressure on an object (e.g. a print media 170) disposed on the exterior surface of the conveyor belt 110 to hold the print media 170 in place against the conveyor belt 110. In such implementations, the conveyor belt 110 can include openings, channels, or holes through which the vacuum handler 120 can apply the vacuum to the print media 170. The vacuum handler 120 can thus provide a force that increases the friction between the print media 170 and the exterior surface of the conveyor belt 110, to prevent the print media 170 disposed on the exterior surface of the conveyor belt 110 from slipping as the conveyor belt 110 moves. As such, when the conveyor belt 110 moves, it can be assumed that the print media 170 also moves with no slippage. For example, the vacuum handler 120 can hold print media 170 (such as paper, cardstock, boards, metal sheets, plastic sheets, and the like) securely to the exterior of the conveyor belt 110 so that when the conveyor belt moves, the print media also moves without slipping, curling, or lifting.

In various implementations of the present disclosure, information regarding the relative lateral movement of the conveyor belt 110 can be used to apply corrections in association with a print job of the printing system 100. For example, if a lateral displacement and/or size change of the conveyor belt 110 is detected, then a corresponding correction may be applied to the print data and/or the print engine 150 to compensate for the lateral displacement and/or size change of the conveyor belt 110.

Figure 3:
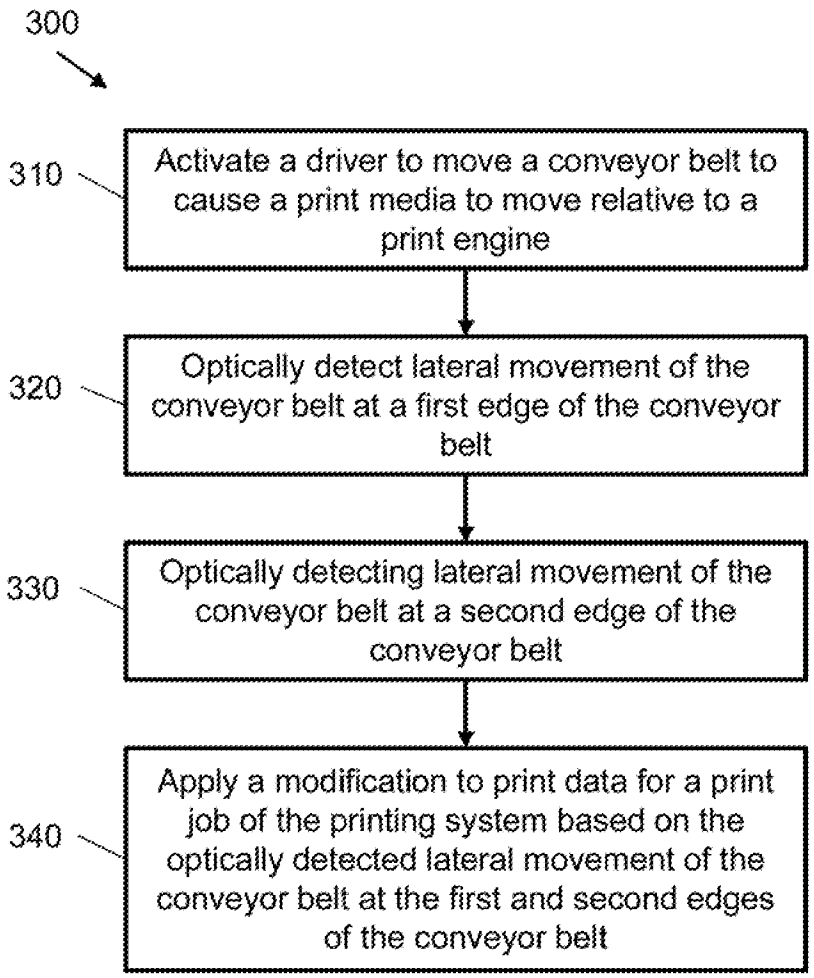
FIG. 3 is a flow diagram showing a method of operating a printing system according to an example.

FIG. 3 is a flowchart of an example method 300 of operating a printing system. The printing system may comprise one of the printing system examples previously described. The method begins at block 310 in which a driver is activated to move a conveyor belt to cause a print media to move relative to a print engine. The driver may comprise a drive roller according to an implementation previously described thereof. The print media may be disposed on the conveyor belt, and the printing system may comprise another roller, for example an idle roller as described in previous examples.

In examples, activating the driver can include sending drive signals to the driver to move a print media disposed on the conveyor belt in coordination with the operation of the print engine to render a printed image on the print media.

At block 320, lateral movement of the conveyor belt at a first edge of the conveyor belt is optically detected. The optical detection may be performed by a first optical sensor, which may be an implementation of an example optical sensor previously described. For example, the optical detection may comprise detecting variations in the light levels detected in, on, or through the conveyor belt by the first optical sensor. In some examples, optically detecting lateral movement of the conveyor belt at the first edge of the conveyor belt may comprise detecting variation in reflected light on an interior surface of the conveyor belt using the first optical sensor located proximate to the interior surface of the conveyor belt.

In certain examples, the interior surface of the conveyor belt comprises a first ridge and a second ridge. The first optical sensor may be located proximate to the first ridge and the second optical sensor may be located proximate to the second ridge in these examples.

At block 330, lateral movement of the conveyor belt at a second edge of the conveyor belt is detected, wherein the second edge is on the opposite side of the conveyor belt to the first edge. The optical detection may be performed by a second optical sensor, which may be an implementation of an example optical sensor previously described. In some examples, optically detecting lateral movement of the conveyor belt at the second edge of the conveyor belt may comprise detecting variation in reflected light on the interior surface of the conveyor belt using the second optical sensor located proximate to the interior surface of the conveyor belt.

At block 340, a modification is applied to print data for a print job of the printing system. The modification is based on the optically detected lateral movement of the conveyor belt at the first and second edges of the conveyor belt. The modification may be applied to the print data as described in previous implementations. For example, the printing system may comprise a controller to receive data from the first and second optical sensors, wherein the data may comprise light level signals from the optical sensors corresponding to variations in the light levels detected in, on, or through the conveyor belt at respective regions of the conveyor belt. In various implementations described herein, the light levels detected can correspond to detecting the movement of markings or inherent patterns on the interior surface of the conveyor belt 110. To determine the lateral movement or position of the conveyor belt 110, the controller can analyze the light level signals.

The modification to the print data, based on the optically determined lateral movement or position of the conveyor belt, can then be caused or directly applied by the controller. For example, the controller may communicate with a buffer or other memory that stores the print data, and may cause the buffer or memory to modify the print data.

Figure 4:
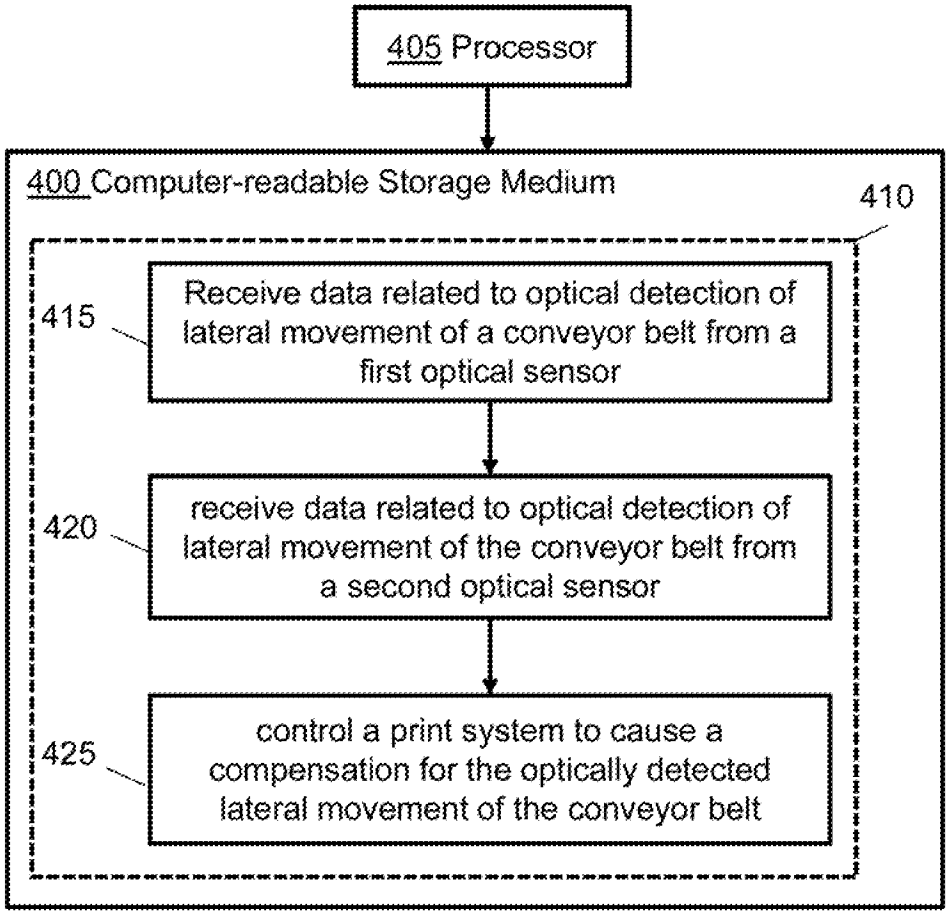
FIG. 4 is a schematic illustration showing a non-transitory computer-readable storage medium, coupled to a processor, and comprising instructions according to an example.

FIG. 4 shows a non-transitory computer-readable storage medium 400, coupled to a processor 405 of a printing system, and comprising computer readable instructions 410 according to an example. The computer readable instructions 410 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

At block 415, the instructions 410 cause the processor 405 to receive data related to optical detection of lateral movement of a conveyor belt from a first optical sensor located proximate to a first edge of the conveyor belt. Optical detection of lateral movement of a conveyor belt may be performed as described in examples herein.

At block 420, the instructions 410 cause the processor 405 to receive data related to optical detection of lateral movement of the conveyor belt from a second optical sensor located proximate to a second edge of the conveyor belt, wherein the second edge is on the opposite side of the conveyor belt to the first edge.

At block 425, the instructions 410 cause the processor 405 to control a printing system to cause a compensation for the optically detected lateral movement of the conveyor belt at the first and second edges of the conveyor belt in association with a print job of the printing system.

In some implementations, the compensation comprises modifying print data associated with the print job, as described in examples herein. In these implementations, the print data may be stored in a buffer communicatively coupled to a print engine of the printing system. The print engine may apply a printing material to a print media transported by the conveyor belt based on the modified print data.

In other implementations, the compensation may comprise modifying a physical position of the print engine. For example, such modification of the position of the print engine may be prior to the print engine applying the printing material (such as ink) to the print media as part of a print job of the printing system.

The preceding description has been presented to illustrate and describe examples of the principles described. This description is not intended to be exhaustive or to limit these principles to any precise form disclosed. Many modifications and variations are possible in light of the above teaching.

For example, optical sensors are described in the preceding example implementations to optically detect lateral movement of the conveyor belt. However, implementations are envisaged where non-optical sensors are employed, such as magnetic sensors, which can detect lateral movement of the conveyor belt non-optically.

As used in the description herein and throughout the daims that follow, "a", "an", and "the" includes plural references unless the context dearly dictates otherwise. Also, as used in the description herein and throughout the claims that follow, the meaning of "in" includes "in" and "on" unless the context dearly dictates otherwise.

It is to be understood that any feature described in relation to any one example may be used alone, or in combination with other features described, and may also be used in combination with any features of any other of the examples, or any combination of any other of the examples.

What is claimed is:

1. A printing system comprising:

a conveyor belt;

a first optical sensor located proximate to a first edge of the conveyor belt;

a second optical sensor located proximate to a second edge of the conveyor belt, wherein the second edge is on the opposite side of the conveyor belt to the first edge, and the first and second optical sensors are located within a lateral width of the conveyor belt and directed at a surface of the conveyor belt within the lateral width of the conveyor belt; and a controller to:

receive data related to optical detection of lateral movement of the conveyor belt from the first and second optical sensors; and cause a correction for the detected lateral movement of the conveyor belt in association with a print job of the printing system;

wherein the conveyor belt comprises an interior surface comprising a first ridge and a second ridge, the first and second ridges running in a direction parallel with a length and conveyance direction of the conveyor belt, wherein:

the first optical sensor is located proximate to the first ridge to detect lateral movement of the conveyor belt by optically detecting the first ridge; and the second optical sensor is located proximate to the second ridge to detect lateral movement of the conveyor belt by optically detecting the second ridge.

2. The printing system of claim 1, comprising a print engine, the conveyor belt to move a print media relative to the print engine, the controller to cause the correction to modify print data associated with the print job, the print data for rendering an image on the print media with the print engine.

3. The printing system of claim 2, the modified print data causing a modification to the image rendered on the print media.

4. The printing system of claim 1, comprising a print engine, the conveyor belt to move a print media relative to the print engine, the controller to cause the correction to the print engine to apply a printing material to the print media.

5. The printing system of claim 4, wherein the correction to the print engine comprises a modified physical position of the print engine.

6. The printing system of claim 1, the controller to cause the correction to modify a lateral position of the conveyor belt.

7. The printing system of claim 1, comprising:

a drive roller to move the conveyor belt, the drive roller comprising a first groove; and an idle roller comprising a second groove, wherein the conveyor belt is disposed around the drive roller and the idle roller with the first ridge disposed in the first and second grooves to maintain alignment of the conveyor belt.

8. The printing system of claim 7, wherein:

the drive roller comprises a third groove;

the idle roller comprises a fourth groove; and the second ridge is disposed in the third and fourth grooves to maintain alignment of the conveyor belt.

9. The printing system of claim 1, wherein the first ridge comprises one or more markings detectable by the first optical sensor, and the second ridge comprises one or more markings detectable by the second optical sensor.

10. The printing system of claim 1, wherein the first ridge and the second ridge both have a v-shaped profile with a tip of the profile of each ridge being centered with respect to a respective one of the first and second optical sensors when the conveyor belt is aligned.

11. The printing system of claim 1, the first and second optical sensors to detect light reflected by the lateral width of the conveyor belt.

12. The printing system of claim 1, the first and second optical sensors to detect light passing through the conveyor belt.

13. The printing system of claim 11, wherein the conveyor belt further comprises contrasting levels of reflectance across the lateral width of the conveyor belt.

14. The printing system of claim 1, wherein the controller is further to determine a degree of lateral expansion or contraction of the conveyor belt based on the received data from the first and second optical sensors.

15. A method of operating a printing system, the method comprising:

activating a driver to move a conveyor belt to cause a print media to move relative to a print engine, the conveyor belt comprising first and second ridges each having a ridge line oriented in a direction parallel with a length and conveyance direction of the conveyor belt;

optically detecting lateral movement of the conveyor belt by optically detecting the first ridge at a first edge of the conveyor belt;

optically detecting lateral movement of the conveyor belt by optically detecting the second ridge at a second edge of the conveyor belt, wherein the second edge is on the opposite lateral side of the conveyor belt to the first edge;

applying a modification to print data for a print job of the printing system based on the optically detected lateral movement of the conveyor belt at the first and second edges of the conveyor belt.

16. The method of claim 15, wherein optically detecting lateral movement of the conveyor belt at the first edge of the conveyor belt comprises detecting variation in reflected light on an interior surface of the conveyor belt using a first optical sensor located proximate to the interior surface of the conveyor belt, and wherein optically detecting lateral movement of the conveyor belt at the second edge of the conveyor belt comprises detecting variation in reflected light on the interior surface of the conveyor belt using a second optical sensor located proximate to the interior surface of the conveyor belt.

17. The method of claim 16, wherein the first ridge and the second ridge have a v-shaped profile with a tip of the profile of each ridge being centered with respect to a respective optical sensor when the conveyor belt is properly aligned.

18. A non-transitory computer-readable storage medium storing instructions for a processor of a printing system that comprises a conveyor belt comprising first and second ridges each having a ridge line oriented in a direction parallel with a length and conveyance direction of the conveyor belt, the instructions, when executed by the processor of the printing system, cause the processor to:

receive data related to optical detection of lateral movement of a conveyor belt by optically detecting the first ridge with a first optical sensor located proximate to a first edge of the conveyor belt;

receive data related to optical detection of lateral movement of the conveyor belt by optically detecting the second ridge with a second optical sensor located proximate to a second edge of the conveyor belt, wherein the second edge is on the opposite side of the conveyor belt to the first edge, and the first and second optical sensors are located within a lateral width of the conveyor belt and directed at a surface of the conveyor belt within the lateral width of the conveyor belt; and control a printing system to cause a compensation for the optically detected lateral movement of the conveyor belt at the first and second edges of the conveyor belt in association with a print job of the printing system.

19. The non-transitory computer-readable storage medium of claim 18, the compensation comprising modifying print data associated with the print job.

* * * * *